US006484467B2

(12) United States Patent
Crout

(10) Patent No.: US 6,484,467 B2
(45) Date of Patent: Nov. 26, 2002

(54) TIMBER DECKING

(76) Inventor: Brian Richard Crout, 33 Twickenham Road, Newton Abbot, Devon, TQ 12 4JE (GB)

( * ) Notice: Subject to any disclaimer, the term of this patent is extended or adjusted under 35 U.S.C. 154(b) by 0 days.

(21) Appl. No.: 09/814,504

(22) Filed: Mar. 22, 2001

(65) Prior Publication Data

US 2001/0027829 A1 Oct. 11, 2001

(30) Foreign Application Priority Data

Apr. 8, 2000 (GB) ..... 0008593

(51) Int. Cl.[7] ..... E04B 5/00

(52) U.S. Cl. ..... 52/483.1; 52/586.1; 52/592.1; 52/302.1

(58) Field of Search ..... 52/586.1, 586.2, 52/177, 384, 385, 480, 779, 509, 512, 302.1, 302.3, 391, 390, 392, 592.1, 489.1, 481.1, 483.1; 404/40, 46; 144/353; 403/280, 292

(56) References Cited

U.S. PATENT DOCUMENTS 186,463 A * 1/1877 Dickinson ..... 52/512
582,645 A * 5/1897 Heaton ..... 52/512
695,722 A * 3/1902 Heilmann ..... 52/509
1,018,987 A * 2/1912 Philpot et al. ..... 52/177
1,714,738 A * 5/1929 Smith ..... 52/512
1,888,611 A * 11/1932 Wolfson ..... 52/512
1,946,646 A * 2/1934 Storm
2,038,433 A * 4/1936 Lawrence, Jr. ..... 52/512
2,835,938 A * 5/1958 McElroy
3,031,725 A * 5/1962 Omholt ..... 52/480 X
3,200,553 A * 8/1965 Frashour et al.
3,214,802 A * 11/1965 Davis
3,235,920 A * 2/1966 Davis
3,374,703 A * 3/1968 Davis et al.
3,427,771 A * 2/1969 Cacossa ..... 52/779 X
4,154,172 A * 5/1979 Curtis, Jr. ..... 52/489.1 X
4,170,859 A * 10/1979 Counihan ..... 52/586.1 X
4,193,230 A * 3/1980 Piana ..... 52/509 X
4,443,988 A * 4/1984 Coutu ..... 52/586.1 X
4,512,131 A * 4/1985 Laramore ..... 52/586.1
4,599,841 A * 7/1986 Haid ..... 52/586.2 X
4,599,842 A * 7/1986 Counihan ..... 52/586.2
4,703,601 A * 11/1987 Abendroth ..... 52/509
5,394,667 A * 3/1995 Nystrom ..... 52/480
5,660,016 A * 8/1997 Erwin et al. ..... 52/586.2 X
5,694,730 A * 12/1997 Del Rincon et al. ... 52/586.2 X
5,850,720 A * 12/1998 Willis ..... 52/480 X
5,997,209 A * 12/1999 Sachs ..... 52/480 X
6,314,699 B1 * 11/2001 West ..... 52/177 X
6,385,936 B1 * 5/2002 Schneider

FOREIGN PATENT DOCUMENTS

DE 2714965 * 10/1978 ..... 52/586.2
FR 2801943 * 6/2001

* cited by examiner

*Primary Examiner*—Robert Canfield
(74) *Attorney, Agent, or Firm*—Ira S. Dorman

(57) ABSTRACT

Decking boards 2 are secured to timber joists 1. The opposing side faces of the boards are provided with longitudinally-extending recesses 7 which include slots 8 into which T-shaped spacers 11 are inserted at intervals to ensure uniform spacing between the boards. During laying the exposed front edge of each board is fastened by nails 10 inserted through the inclined face 9, the rear edge of the boards being held by the spacers 11.

6 Claims, 2 Drawing Sheets

TIMBER DECKING

TECHNICAL FIELD OF THE INVENTION

This invention relates to timber decking.

BACKGROUND

Timber decking is currently very popular in gardens and other external locations. In the construction of decking, a supporting timber framework is built which includes spaced joists. Decking bards are then nailed or screwed to the joists to form a platform. Since timber boards expand when wet and shrink when dry it is necessary to leave an expansion gap between the boards, which is usually achieved by inserting temporary spacers (e.g. nails or pieces of wood) between the boards to ensure that a uniform and aesthetically attractive result is achieved. The expansion gaps also provide drainage spaces to prevent rain water from forming puddles on the decking platform.

It is known from WO 95/25 856 (U.S. Pat. No. 5,997,209) to fasten the decking board to the underlying joists by means of a metal clip. The clip has a plate which is fixed to the side of the joist and one or more spacing flanges which are interposed between the joists and the boards. An upstanding spacer is located between the adjacent planks with opposed axially aligned teeth which bite into the opposing side faces of the adjacent boards. Such fixing clips would not be very easy to use. Firstly uniform spacing of the boards can only be ensured if all of the teeth are driven into the boards to the same extent, and secondly it is necessary to fix the clips to the joists below the edge of the boards, where access is not easy. In addition, the teeth cause damage to the sides of the board allowing the ingress of water which can quickly lead to decay even in pressure treated boards.

The present invention seeks to provide a new and inventive form of decking which takes less time to install and is aesthetically more attractive than existing decking.

SUMMARY OF THE INVENTION

The present invention provides decking boards for use in the construction of timber decking, in which opposite side faces of the boards are both formed with continuous recesses which extend longitudinally of the boards to receive spacers.

Spacers may be permanently and unobtrusively inserted into the recesses to determine the gap between the boards during construction of the decking. The use of such spacers removes the need for insertion and removal of temporary spacers, and ensures that the boards are uniformly spaced to achieve an aesthetically attractive result.

The recesses preferably include slots which extend longitudinally of the boards and into which the spacers may be inserted.

The spacers preferably have a pair of oppositely-projecting flanges for insertion into the opposing slots, and there is preferably at least one projecting stem between the flanges for abutment with the opposing side faces of the boards.

The recesses preferably have an inclined bottom face through which fixing elements can be inserted to secure the boards to the joists of a supporting framework. By screwing or skew nailing the leading side faces of the boards as they are laid the fixing elements are substantially hidden from view. The rear edges of the boards are held down by the spacers.

The invention also provides a spacer for use in the construction of timber decking and having a pair of opposed flanges for insertion into continuous recesses in the opposed side faces of a pair of decking boards, in which the flanges are formed by resilient plates with a non-planar configuration.

The invention further provides timber decking which includes decking boards secured to a supporting framework, in which opposite side faces of the boards are both formed with continuous recesses which extend longitudinally of the boards to receive spacers having opposed flanges inserted into the recesses.

Moreover, the invention provides a method of constructing timber decking which includes decking boards fixed to a supporting framework, in which the opposing side faces of the boards are formed with continuous recesses which extend longitudinally of the boards, and spacers are inserted into the recesses as the boards are laid.

The method preferably includes inserting fixing elements through an inclined bottom face of the recess on the leading side face of the boards to secure the boards to the supporting framework.

BRIEF DESCRIPTION OF THE DRAWINGS

The following description and the accompanying drawings referred to therein are included by way of non-limiting example in order to illustrate how the invention may be put into practice. In the drawings.

DETAILED DESCRIPTION OF THE DRAWINGS

Figure 1:
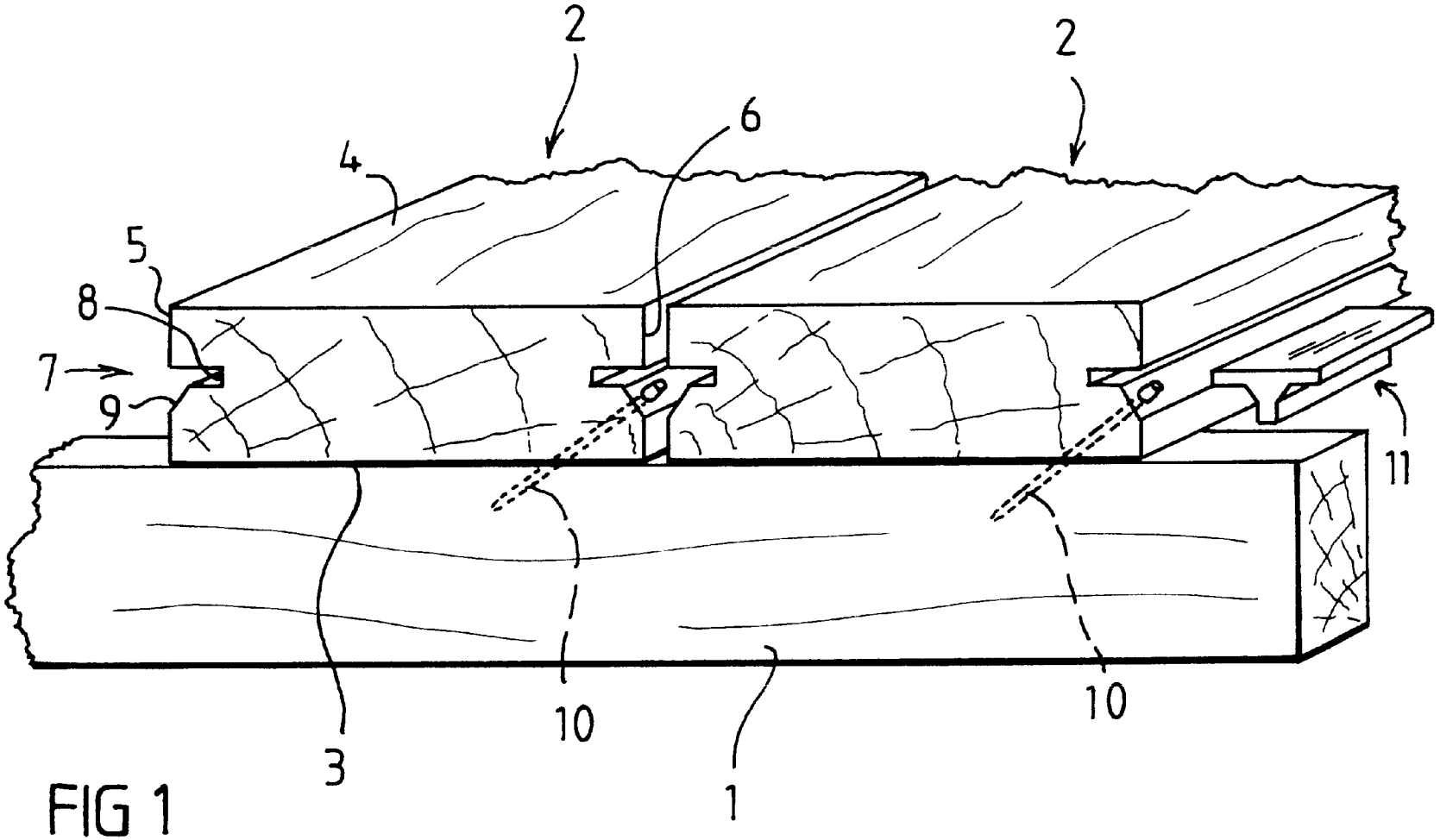
FIG. 1 is a sectional view of timber decking in accordance with the invention showing the decking boards in end view.

In the construction of the outdoor decking shown in FIG. 1, a supporting timber framework is built which includes a series of spaced parallel joists 1 to which timber decking boards 2 are fixed to form a platform. For outdoor use the boards and joists will be impregnated with a known preservative. The boards are of generally rectangular section with a planar bottom face 3 and a top face 4 which may be planar as shown, longitudinally ribbed or otherwise profiled for improved slip resistance. The opposing side faces 5 and 6 of the boards are provided with longitudinally-extending recesses 7 which include slots 8 extending substantially parallel with the top and bottom faces 4 and 3. The top faces of the slots 8 meet the respective side face 5 or 6 substantially perpendicularly, but the bottom faces of the slots join the respective side face 5 or 6 via a downwardly and outwardly inclined bottom face 9.

In laying the decking boards the exposed leading side face 6 of each board is skew nailed to the underlying joists 1 by driving nails 10 through the inclined, upwardly directed face 9. The nails may be hammered in or driven in using a manually or pneumatically operated power-assisted nailing tool. The nails are inserted generally perpendicular to the face 9 which minimises damage to the decking boards and ensures a sound fixing. Spacers 11 are then inserted at intervals into the slots 8. The spacers can be inserted in any position along the boards but it is preferable for the spacers to cover the nails 10 since they effectively prevent ingress of water where the nails enter the boards.

Figure 2:
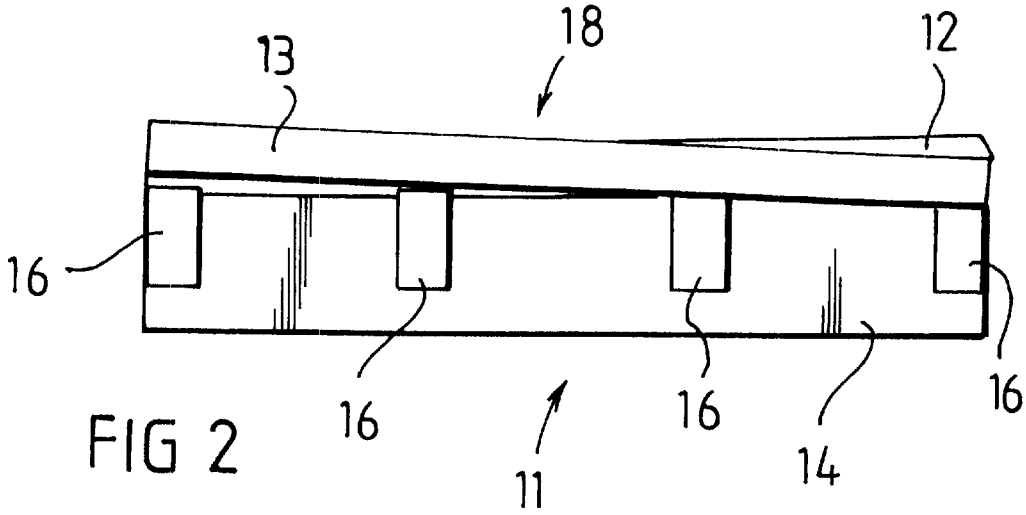
FIG. 2 is a side view of a spacer which is used with the decking.
Figure 3:
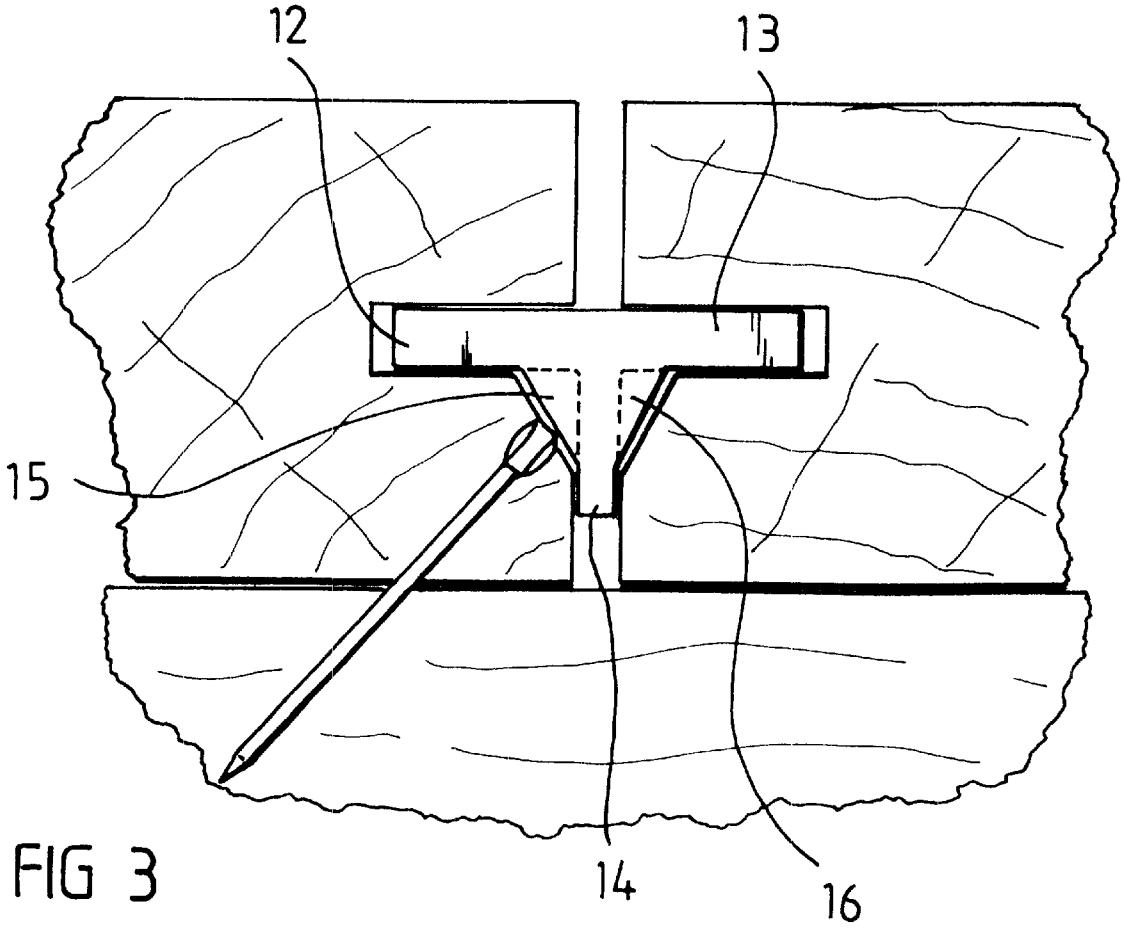
FIG. 3 is a section through the opposing faces of two adjacent decking boards showing the spacer in end view.

The spacers 11, best seen in FIGS. 2 and 3, are moulded of plastic, although they could also be formed of other materials, e,g, extruded from metal or machined from a hardwood. Each spacer is generally T-shaped with a pair of opposed flanges 12 and 13 and a depending intermediate stem 14. Pairs of opposed triangular strengthening fillets 15 and 16 join the stem 14 to the flanges 12 and 13 at intervals along the length of the spacer, as shown in FIG. 2. Although the flanges 12 and 13 are substantially co-planar they are in fact formed with a slight twist, which can be seen in FIG. 2. Thus, at the left hand end of the spacer (when viewed as in FIG. 2) the flange 13 is upwardly inclined away from the stem 14 while the opposed flange 12 is downwardly inclined relative to the stem. At the central region 18 the two flanges project substantially normal to the stem, while at the right hand end the flange 13 is downwardly inclined and the flange 12 upwardly inclined.

As shown in FIG. 3, one of the flanges 12 is inserted into the leading recess 7 of the board which has just been nailed down, and the next board is then positioned so that the projecting flange 13 enters the opposing slot 8. The board is then nailed down in the same way. The skew nailing ensures that the opposing faces of the adjacent boards are pushed hard against the stems 14 which thus set the minimum gap between the two boards, as can be seen in FIG. 3. It will be noted that the flanges 12 and 13 do not contact the inner faces of the slots 8 to allow for expansion of the boards. There should also be an expansion gap between the fillets 15, 16 and the inclined faces 9, as shown. The stem 14 does not, in practice, impede expansion of the boards since it tends to become embedded in the boards upon expansion.

The slight twist formed on the flanges 12 and 13 provides an interference fit in the slots 8 as the flanges untwist towards a more-planar configuration when urged into the slots. Such an interference action allows for slight variations in the size of the slots and also ensures that the trailing edges of the boards are securely held. If the boards should shrink the inherent resilience of the spacers causes the flanges to return towards their natural configuration and maintains an interference with the slots 8.

The inclined faces 8 at the rear side faces of the boards are not used for nailing, but the use of symmetrical boards eliminates the time which would be required to correctly orientate handed boards during laying. With known means of fixing decking boards it is necessary to position the abutting ends of cut boards over a joist so that they are adequately supported. However, if two spacers are positioned on opposite sides of the boards bridging the cut ends the spacers will support the abutting ends so that it is no longer necessary to position them over a joist. Thus, the boards do not have to be trimmed in length, which results in a considerable further saving in time and timber.

It will thus be appreciated that the process of laying the boards is quick and simple and ensures a uniformly spaced result. Drainage is not impeded by the spacers and since the nails are hidden by the top face of the recesses 7, and are preferably also covered by the spacers 11, they are not visible in the completed decking.

It will be appreciated that the features disclosed herein may be present in any feasible combination. Whilst the above description lays emphasis on those areas which, in combination, are believed to be new, protection is claimed for any inventive combination of the features disclosed herein.

What is claimed is:

1. Timber decking which includes decking boards secured to a supporting framework, in which opposite side faces of the boards are both formed with continuous recesses which extend longitudinally of the boards to receive spacers having opposed flanges inserted into the recesses, wherein the recesses incorporate continuous slots, and an inclined face is formed between the bottom of each slot and the adjacent side face of the board through which fixing elements are inserted to secure the boards to a supporting framework.

2. Timber decking which includes decking boards secured to a supporting framework, in which opposite side faces of the boards are both formed with continuous recesses which extend longitudinally of the boards to receive spacers having opposed flanges inserted into the recesses, the flanges being formed by a common resilient plate having a slight twist.

3. Timber decking according to claim 2, in which each spacer includes an intermediate stem between the opposed flanges for determining the spacing between adjacent boards.

4. Timber decking according to claim 3, in which a plurality of spaced fillets connect the stem to each flange.

5. A spacer for use in the construction of timber decking and having a pair of opposed flanges for insertion into continuous recesses in the opposed side faces of a pair of decking boards, in which the flanges are formed by resilient plates with a non-planar configuration, the spacer additionally including an intermediate stem between the opposed flanges for determining the spacing between adjacent boards, and a plurality of spaced fillets connecting the stem to each flange.

6. A spacer according to claim 5, in which includes the flanges are formed by a common resilient plate having a slight twist.

* * * * *